US010456661B2

(12) United States Patent
Finnerty et al.

(10) Patent No.: US 10,456,661 B2
(45) Date of Patent: Oct. 29, 2019

(54) ENHANCED SECURITY AND PRINTABILITY OF INSTANT TICKET SCRATCH-OFF-COATINGS VIA STOCHASTIC OVERPRINTS

(71) Applicant: Hydra Management LLC, New York, NY (US)

(72) Inventors: Fred W. Finnerty, Dawsonville, GA (US); Kenneth E. Irwin, Jr., Dawsonville, GA (US)

(73) Assignee: Hydragraphix LLC, New York, NY (US)

( * ) Notice: Subject to any disclaimer, the term of this patent is extended or adjusted under 35 U.S.C. 154(b) by 63 days.

(21) Appl. No.: 15/213,459

(22) Filed: Jul. 19, 2016

(65) Prior Publication Data

US 2018/0021668 A1 Jan. 25, 2018

(51) Int. Cl.

| | |
|---|---|
| ***B42D 25/27*** | (2014.01) |
| ***B41M 3/06*** | (2006.01) |
| ***A63F 3/06*** | (2006.01) |
| ***B41M 3/00*** | (2006.01) |

(52) U.S. Cl.

CPC ..... *A63F 3/0665* (2013.01); *A63F 3/0605* (2013.01); *B41M 3/005* (2013.01); *B42D 25/27* (2014.10)

(58) Field of Classification Search

CPC ..... A63F 3/065; A63F 3/0655; A63F 3/0665; A63F 2003/066

USPC ..... 283/100, 102, 903

See application file for complete search history.

(56) References Cited

U.S. PATENT DOCUMENTS

| | | | |
|---|---|---|---|
| 5,286,061 | A | 2/1994 | Behm |
| 5,544,881 | A | 8/1996 | Rua, Jr. et al. |
| 5,569,512 | A | 10/1996 | Brawner et al. |
| 5,601,887 | A | 2/1997 | Rich et al. |
| 5,681,065 | A | 10/1997 | Rua, Jr. et al. |
| 5,704,647 | A | 1/1998 | Desbiens |
| 5,769,458 | A | 6/1998 | Carides et al. |
| 5,803,504 | A | 9/1998 | Deshiens et al. |

(Continued)

FOREIGN PATENT DOCUMENTS

| | | | |
|---|---|---|---|
| CA | 2015351 | A1 | 10/1991 |
| CA | 2359581 | A1 | 1/2002 |

(Continued)

OTHER PUBLICATIONS

Stochastic Printing vs. Conventional Printing (2015) https://hidefcolor.com/blog/printing/stochastic-printing-vs-conventional-printing/.*

(Continued)

*Primary Examiner* — Kyle R Grabowski

(74) *Attorney, Agent, or Firm* — Panitch Schwarze Belisario & Nadel LLP

(57) ABSTRACT

A removable scratch-off document with a display portion, printing method and system ensuring the integrity and security of the document with variable win and lose variable information protected by a scratch-off coating by overprinting at least one of at least a part of the scratch-off coating and at least a part of the display portion using stochastic imaging. The resulting printed document is more attractive and consistent over varying surfaces, as well as more secure against illicit attempt to remove the scratch-off coating by lift and float techniques.

10 Claims, 7 Drawing Sheets
(4 of 7 Drawing Sheet(s) Filed in Color)

(56) References Cited

U.S. PATENT DOCUMENTS

| | | | | |
|---|---|---|---|---|
| 6,506,475 | B1 * | 1/2003 | Hill | B41M 1/18 156/107 |
| 7,455,323 | B2 | 11/2008 | Taylor et al. | |
| 7,472,926 | B2 | 1/2009 | Friesen et al. | |
| 7,520,952 | B1 | 4/2009 | Green et al. | |
| 7,665,732 | B2 | 2/2010 | Stephens | |
| 7,720,421 | B2 | 5/2010 | Snyder | |
| 8,074,570 | B2 | 12/2011 | Grotkowski et al. | |
| 8,342,576 | B2 | 1/2013 | Eschbach et al. | |
| 8,366,153 | B2 | 2/2013 | Martineck, Sr. | |
| 8,883,390 | B1 | 11/2014 | Tyagi et al. | |
| 2004/0091680 | A1 | 5/2004 | Hill | |
| 2006/0170974 | A1 | 8/2006 | Wang et al. | |
| 2007/0164559 | A1 | 7/2007 | Kozdras | |
| 2007/0281224 | A1 | 12/2007 | Kirk et al. | |
| 2008/0014379 | A1 * | 1/2008 | Shibaoka | A63F 3/06 428/29 |
| 2008/0122220 | A1 | 5/2008 | Brickwood et al. | |
| 2009/0263583 | A1 | 10/2009 | Mantell et al. | |
| 2010/0108874 | A1 | 5/2010 | Zahedi | |
| 2010/0218693 | A1 | 9/2010 | Kozdras | |
| 2011/0001314 | A1 | 1/2011 | Eschbach et al. | |
| 2012/0025516 | A1 | 2/2012 | Miller et al. | |
| 2012/0267888 | A1 * | 10/2012 | Behm | A63F 3/0665 283/100 |
| 2014/0356537 | A1 | 12/2014 | Tyagi et al. | |
| 2017/0209781 | A1 * | 7/2017 | Gaynor | A63F 3/0665 |

FOREIGN PATENT DOCUMENTS

| | | | |
|---|---|---|---|
| CA | 2421241 | A1 | 8/2003 |
| EP | 2550071 | A1 | 1/2013 |
| EP | 2550072 | A1 | 1/2013 |
| EP | 2550073 | | 1/2013 |
| WO | 2010130041 | A1 | 11/2010 |
| WO | 2011117687 | A1 | 9/2011 |

OTHER PUBLICATIONS

Bruce Schneier, "Hacking Scratch Lottery Tickets," Blog, Schneier on Security, Feb. 10, 2011, Downloaded from webpage: <https://www.schneier.com/blog/archives/2011/02/hacking_scratch.html>.

Gary Taylor, "Scratch-off tickets: 'Nontoxic' stuff hides prizes, leaves messes," Orlando Sentinel, Feb. 20, 2011, Downloaded from webpage: <http://articles.orlandosentinel.com/2011-02-20/news/os-lottery-ticket-mess-20110220_1_scratch-off-tickets-food-lotto-florida-lottery>.

International Search Report and Written Opinion dated Sep. 25, 2017 in International Application No. PCT/US17/41482.

Int'l Preliminary Report on Patentability dated Jul. 16, 2018 in Int'l Application No. PCT/US2017/041482.

* cited by examiner

ENHANCED SECURITY AND PRINTABILITY OF INSTANT TICKET SCRATCH-OFF-COATINGS VIA STOCHASTIC OVERPRINTS

FIELD OF THE INVENTION

The present invention relates generally to documents, such as lottery tickets, having variable indicia under a Scratch-Off Coating (SOC), and more particularly to methods for enhancing the security of the documents with countermeasures inhibiting temporarily illicit lifting or removing the SOC to surreptitiously deduce the document's variable indicia information.

BACKGROUND

Lottery scratch-off tickets or instant games have become a time-honored method of raising revenue for state and federal governments the world over. Indeed, the concept of hiding variable indicia information indicating win or lose information, value, codes, etc. under a SOC to be viewed only when the SOC is legitimately removed, has also been applied to numerous other products such as commercial contests, telephone card account numbers, gift cards, etc. Literally, billions of scratch-off products are printed every year where the SOCs are used to ensure that the product has not been previously used, played, or modified. Such documents will be referred to herein generically as "tickets" for the sake of convenience.

Typically the variable indicia are printed using a specialized high-speed ink jet and are sandwiched between lower security ink film layers and upper security barriers that protect the variable indicia from illicit identification in virgin (i.e., unsold) tickets. The purpose is to ensure that the printed variable indicia cannot be read or decoded without first removing the associated SOC in a manner that it would be obvious to a consumer that the variable indicia has been revealed—thereby ensuring that a game or product is secure against picking out winners or extracting confidential information from unsold tickets.

Nevertheless, there are known techniques for illicitly temporarily mechanically "lifting" the SOC and thereby viewing the variable indicia. The term "mechanical lift" refers to a process that uses a flat blade (e.g., X-Acto® chisel blade #17) or other device to peel back a portion of the SOC to reveal previously hidden variable indicia. The SOC is then glued back into place such that it is not obvious that the integrity of the SOC has been breached. The industry has developed countermeasures to the previously described mechanical lift technique which involve changing the formulation of the SOC so that it is more difficult to remove and/or it flakes off or crumbles, rather than peeling off in one piece, thereby making "unassisted" SOC lifts more difficult. However, these techniques have done nothing to alleviate the vexing problem of "assisted" SOC lifts. Assisted lifts differ from unassisted lifts in that another medium or material is applied to the SOC (e.g., Krylon® acrylic clear spray) to strengthen it, thereby assisting anyone who is attempting a mechanical lift.

In addition to mechanical SOC lifts, there are also various float techniques to attempt to remove the SOC, by which chemical soaking solutions (e.g., alcohol and water) weaken the graphic adhesion between the SOC and its release undercoat to the point where the SOC simply floats to the surface of the soaking solution as a continuous film, thereby revealing the variable indicia. After the SOC floats to the surface and the variable indicia is revealed, the solution is drained off and the continuous SOC film is glued back into place such that it is not obvious that the integrity of the coating has been breached. The industry has attempted to mitigate this threat by either designing the chemistry of the SOC and release undercoat such that the soaking solution will not weaken the graphic adhesion bond or that portions of the ticket will destruct in the presence of the soaking solution. However, these countermeasures are only effective against known soaking solutions and the possibility remains that new soaking chemistry can be developed that can still weaken the release undercoat and the SOC graphic adhesion. Additionally, if destructive countermeasures are employed where portions of the ticket disintegrate or are damaged in the presence of the soaking solution, unfortunately, it becomes possible for the ticket to be destroyed through innocent consumer handling—e.g., spilling an alcoholic drink on the ticket, accidentally leaving the ticket in a pocket of clothing when the clothing was being washed, etc.

Similar to chemical soaks, there are a variety of SOC lifting attacks that incorporate heat and other possible chemical reactants. In one form of this type of attack, the ticket on a hot plate backside down where the entire ticket is heated to the point that the SOC becomes more pliable. At this point a mechanical lift can be attempted, aided by the more pliable SOC. A variation of this technique is to add a chemical solvent by lightly patting the SOC surface with a cloth moistened with the solvent, thereby adding a chemical assist to the heat application. Another variation of this technique is to place a cloth dampened with a chemical solvent over the SOC and press a hot iron on top of the cloth for a predetermined time period. Industry countermeasures to these types of attacks typically involve altering the chemical bond between the SOC and the release undercoat to ensure sufficient graphic adhesion under these conditions or to alter the SOC's chemistry such that it either destructs or does not become pliable under these conditions. As before, these countermeasures are potentially only effective to known attacks and may risk the possibility of the ticket being destroyed during normal consumer wear and tear. Additionally, as the chemistry of the SOC and its associated release undercoat are increasingly altered to provide countermeasures for the ever-increasing pool of SOC lift attacks, it becomes increasingly difficult to ensure that the SOC will perform as intended for normal consumer usage, particularly over time and under high temperature conditions—e.g., being left on a car's dashboard for an extended time period in a hot climate, such as in Ariz., N. Mex., or Nev. during the summer.

Some attempts to mitigate the problem of SOC lift attacks have been attempted—e.g., European Patents: 2,550,071 and 2,550,072 and European application 2,550,073 A1. However, the '071 patent has the disadvantage of requiring fine fingerprint, water flow, or Benday-line overprints that typically negatively impact the aesthetics of the ticket. The '072 patent discloses manufacturing an irregular release coating thickness that adds to the complexity of the ticket design and can create undesirable areas where the SOC is difficult for the consumer to remove, thereby creating another negative impact on ticket aesthetics. Lastly, the 073' application discloses " . . . applying an overcoat material over the scratch-off coating; and wherein the overcoat material is formulated with a reactant that reacts with chemicals used in assisted mechanical lift attempts and produces a visual indication of the use of such chemicals . . . " (Claim 1); however, as previously discussed, this technique introduces the possibility for the ticket to be destroyed through innocent consumer handling and is only theoretically effective against a priori known chemical attacks.

U.S. Pat. Nos. 5,569,512 and 5,601,887 disclose printing continuous overprints that mask the boundaries between "secure" and "unsecure" portions of the ticket for a greater aesthetic effect, as well as possible reduction in the number of printing stations required. However, the "continuous overprints" as envisioned by the '512 and '887 patents fail to address any SOC mechanical lifting security related issues. Additionally, continuous overprints can be difficult to print, due to the differences between substrates for the display portion (i.e., decorative, non-secure portion of the ticket that does not scratch-off—typically coated directly or indirectly on one side of the paper or other type of substrate) and the SOC portion (i.e., the secure portion of the ticket that does scratch-off—typically multiple layers of security ink films with a rough surface and relatively low graphic adhesion). These differences between the display and SOC portions are typically difficult to print as a whole in an aesthetically pleasing basis (e.g., color matching and line widths tend to vary from the SOC to the display portions) especially with fixed plate printing techniques that are standard in the art. Nevertheless, the '887 patent does disclose ticket embossing as a countermeasure for SOC lifting attacks. Though, ticket embossing is both complex and costly, consequently greatly increasing set-up time and costs between different ticket print runs.

U.S. Pat. No. 5,681,065 discloses various chemical formulations and physical layers designed to protect the variable indicia in a ticket from unauthorized detection; but, fails to address SOC lifting attacks, and as previously discussed, is only theoretically effective against then-known chemical attacks. Furthermore, the '065 patent discusses ink film layers that may be destroyed through innocent consumer handling.

Finally, U.S. Pat. No. 5,803,504 discloses printing color screened half-tone images in ticket SOC overprint portions. Additionally, the '504 patent identifies minimal SOC lifting security related benefits inherent in screened color half-tone images in ticket SOC overprint portions, simply stating: "The overprint region therefore provides a level of security to a scratch-off lottery ticket which is superior to prior overprinted lottery tickets. In addition, the appearance of the lottery ticket is significantly improved." (Column 3, lines 35-39). However, screened color half-tone images are difficult to print over irregular surfaces (typical of SOC ink films) with the SOC display portion boundary possibly falsely appearing to be a lift attempt and the SOC portion itself often appearing to include visual defects due to the relatively rough and/or irregular SOC ink film surface. Additionally, by the periodic nature of screened overprints, mechanical SOC lifts may still be conducted with minimal detection so long as the lift cut lines are parallel to the periodic screen printed dots typical of the printing over the SOC using Amplitude Modulation (AM).

It is therefore highly desirable to develop techniques and methods for ensuring the security and integrity of ticket SOCs that are less reliant on special (i.e., predefined attack) circumstances, offering a more robust and generic defense against multiple types of SOC lifting attacks. Particularly, these security techniques should enhance the aesthetics of the ticket, rather than detract from its appearance. Ideally, these security techniques should also enhance the printability (i.e., ease of printing) the ticket.

SUMMARY OF THE INVENTION

Objects and advantages of the invention will be set forth in part in the following description, or may be apparent from this description, or may be learned through practice of the invention.

In accordance with aspects of the invention, a security-enhanced document with a removable SOC, which may be an instant lottery ticket in certain embodiments, includes any manner of suitable substrate, having the variable indicia remaining unreadable until the associated SOC layer is removed. The document has immunity to lifting or floating attacks by providing a persistent visually identifiable indication that a lifting or floating attack was attempted. Additionally, the document's overprint and display portions may be readily produced with minimal aesthetic problems.

One broad aspect of the invention is a security-enhanced document comprising: a substrate; at least one display portion directly or indirectly printed on the substrate providing decorative printing and optionally providing instructions for use of the document; variable indicia directly or indirectly printed on the substrate; at least one release coat applied over the variable indicia; at least one SOC applied over the release coat to maintain the variable indicia unreadable until removal of the SOC; and a stochastic image overprint printed on at least one of at least a part of the SOC and at least a part of the display portion.

Under the broad aspect, the stochastic image overprint is comprised of process colors.

Under the broad aspect, the stochastic image overprint overlays at least a part of the SOC.

Under the broad aspect, the stochastic image overprint overlays at least a part of the display portion.

Under the broad aspect, the stochastic image overprint overlays at least part of the SOC and at least part of the display portion.

Under the immediately preceding aspect, the stochastic image overprint includes a fade trap portion extending beyond the SOC overprint portion onto the display portion.

Under the immediately preceding aspect, the stochastic fade trap portion is wider than 1/72-inch (0.35 mm).

Under the broad aspect, there is a separate stochastic image overprint printed over at least a part of the SOC and there is a separate stochastic image overprint printed over the display portion.

Under the immediately preceding aspect, the stochastic image overprints over the SOC and over the display portion include a combined fade trap portion centered about a demarcation boundary area between the SOC and the display portion.

Under the immediately preceding aspect, the stochastic image overprint fade trap portion is wider than 1/72-inch (0.35 mm).

Under the broad aspect, the stochastic image overprint is comprised of FM imaging. This will be explained hereinafter.

Under the broad aspect, the stochastic image overprint is comprised of hybrid FM-AM imaging. This will also be explained hereinafter.

Another broad aspect of the invention relates to a method aspect. The broad method aspect is a method for making a security-enhanced document comprising a substrate having a SOC over variable indicia, the method comprising: (a) printing at least one display portion directly or indirectly on the substrate providing decorative printing and optionally providing instructions for use of the document; (b) printing variable indicia directly or indirectly on the substrate; (c)

providing at least one release coat applied over the variable indicia; (d) providing least one SOC applied over the release coat to maintain the variable indicia unreadable until removal of the SOC; and (e) printing a stochastic image overprint on at least one of at least a part of the SOC and at least a part of the display portion.

Under the broad method aspect, (d) comprises printing the stochastic image overprint using process colors.

Under the broad method aspect, (d) comprises printing the stochastic image overprint over at least a part of the SOC.

Under the broad method aspect, (d) comprises printing the stochastic image overprint over at least a part of the display portion.

Under the broad method aspect, (d) comprises printing the stochastic image overprint over at least part of the SOC and at least part of the display portion.

Under the broad method aspect, (d) comprises printing the stochastic image overprint to include a fade trap portion extending beyond the SOC overprint portion onto the display portion.

Under the immediately preceding method aspect, (d) comprises printing the stochastic fade trap portion wider than 1/72-inch (0.35 mm).

Under the broad method aspect, (d) comprises separately printing a stochastic image overprint over at least a part of the SOC and separately printing a stochastic image overprint over the display portion.

Under the immediately preceding method aspect, (d) comprises printing the stochastic image overprints over the SOC and over the display portion to include a combined fade trap portion centered about a demarcation boundary area between the SOC and the display portion.

Under the immediately preceding method aspect, (d) comprises printing the stochastic image overprint fade trap portion wider than 1/72-inch (0.35 mm).

Under the broad method aspect, (d) comprises printing the stochastic image overprint using FM imaging. As above, this will be explained hereinafter.

Under the broad method aspect, (d) comprises printing the stochastic image overprint using hybrid FM-AM imaging. As above, this will be explained hereinafter.

BRIEF DESCRIPTION OF THE DRAWINGS

The patent or application file contains at least one drawing executed in color. Copies of this patent or patent application publication with color drawings will be provided by the Office upon request and payment of the necessary fee.

DETAILED DESCRIPTION

Figure 1:
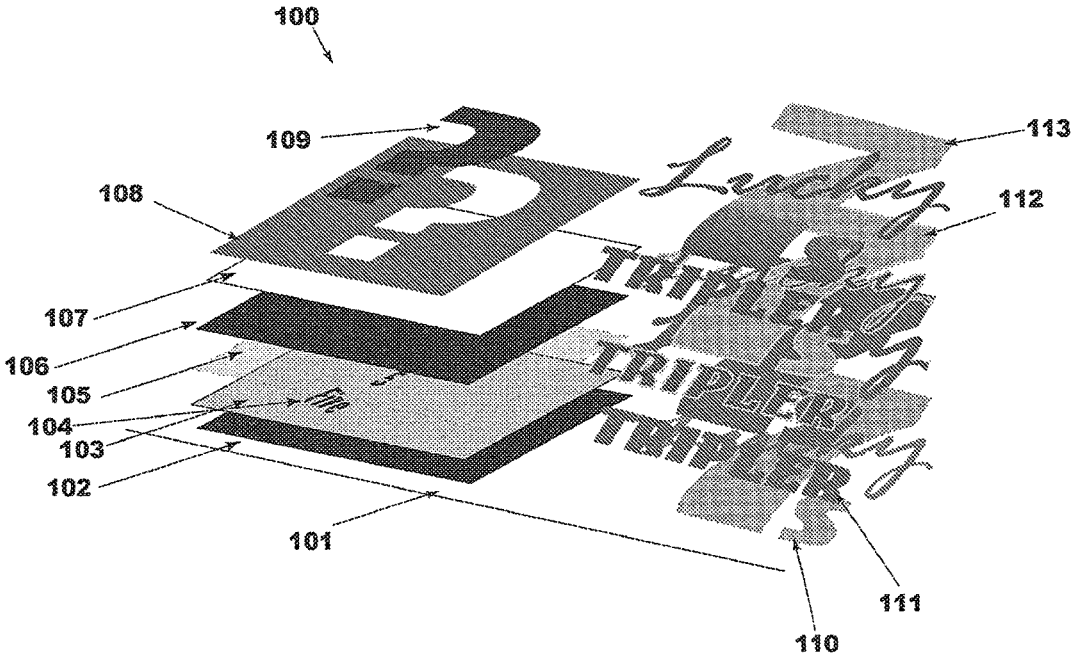
FIG. 1 (Prior Art)
FIG. 1 is an exploded isometric view of a representative example of a traditional lottery-type instant ticket security ink film stack where the variable indicia is sandwiched in the stack with spot color overprints applied to the SOC.

Typically, at least certain portions of tickets, such as the display portion, are printed using Amplitude Modulation (AM), a type of screen printing process where the AM modulates the screen area by changing the size of halftone dots present in an ordered position in a particular area based on predetermined fixed geometric pattern and spacing aspects. With traditional AM imaged halftones, the printed dot size is varied depending on the gray level value of the underlying gray scale image, while the dot frequency is held constant—e.g. clustered-dot ordered dither. Hence AM or "screened" halftones have a periodic grid-like appearance when magnified.

In contrast with AM printing, Frequency Modulation (FM) printing is a type of screen printing process where the FM modulates the screened area by changing the number or density, rather than the size, of randomly distributed dots that appear in a particular area. The FM method which does not use fixed spacing is typically used in stochastic printing, which is often used in computer to plate techniques, often resulting in finer images than images using AM printing. FM halftones have a fixed dot size and shape, but the frequency of the dots varies with the gray level of the underlying gray scale image. Conventional digital FM halftones have a fixed dot size of one pixel—e.g. those produced by dispersed-dot ordered dither and error diffusion. Thus, FM imaged halftones typically appear to be pseudo-randomly dispersed under magnification.

While FM image printing is preferred for the stochastic overprint portions of tickets in the present invention, a combination of FM and AM image printing, hereinafter referred to as "hybrid FM-AM" image printing or imaging, could also be used. Hybrid FM-AM halftones have variable dot shape and/or size and variable dot frequency that depend on the gray level value to be reproduced.

In a particular embodiment, the variable indicia is first imaged on a portion of the ticket with the upper SOC security coatings (e.g., release coat, Upper Blocking Black—"UBB", white opacity layers, etc.) applied directly over the general variable indicia portion(s) and a digital non-line screen image is printed directly over the SOC portion using a form of dithering and/or stochastic printing which as a minimum would be FM imaging and could include a hybrid FM-AM imaging. Dithering is a process by which an intentionally applied form of noise used to randomize quantization error, preventing large-scale patterns such as color banding in images. The stochastic image overprints as used herein preferably include dithering, and the term "stochastic image" should be interpreted to include "dithering" imaging with FM and also including hybrid FM-AM halftones. The stochastic image has the advantage over a line screen AM image of being tolerant to substrate physical irregularities, as well as being extremely visually sensitive to any mechanical dislocation of the continuity of the variable dot or pixel image on the surface of the SOC—i.e., a stochastic image provides visual indications of SOC lifts after the lift have been done. This embodiment also has the advantage that a more common method of printing (e.g., offset, flexographic, gravure, screen, etc.) would be unable to replicate the image, thereby providing additional security countermeasures to duplication. Additionally, stochastic imaging can be digitally tuned to achieve consistent and attractive images while accommodating rougher substrate surfaces typical of a SOC on which such overprints are printed.

In another embodiment, the variable indicia are imaged on a portion of the ticket with at least a portion of the upper SOC security coatings applied over the entire ticket surface. In this embodiment, a non-line screen image photograph or image is digitally printed across the entire ticket surface including the SOC area using a form of stochastic FM or a hybrid FM-AM imaging. This embodiment has the security advantages of the digital stochastic printing previously discussed, while also avoiding many of the difficulties in reliably and aesthetically printing the display and SOC portions of the ticket with a common process color printing medium. Additionally, this embodiment provides an additional countermeasure against SOC floats since the SOC portion (i.e., scratch-off surface, which has low graphic adhesion) and display portion (i.e., static surface, which has high graphic adhesion) share a common ink film.

In both of these embodiments, the variable indicia may be imaged indirectly on the ticket's substrate by imaging the variable indicia on the top of one of potentially several security ink film layers (e.g., lower blocking layer(s) for opacity and printable contrast layer) or also imaged directly on the ticket's substrate (assuming sufficient opacity can be achieved by other means). The essential concept of the invention is to provide added security countermeasures against SOC lifts or floats by printing a stochastic image over at least one of a part of the SOC and at least a part of the display portion to provide an obvious visual indication that a SOC lift or float has occurred after the attempted lift or float has occurred, as well as to provide a countermeasure to copying, while at the same time enhancing printability and aesthetics.

Described are a number of printing mechanisms and methods that provide practical details for reliably producing secure variable indicia under a secure SOC that is inherently immune to various SOC lifting or floating pick-out techniques that physically raise a portion of or the entire SOC such that it can be reapplied to the ticket without detection. These mechanisms and methods also enhance aesthetics and printability. Although the examples provided herein are primarily related to instant tickets, it is clear that the same methods are applicable to any type of document (e.g., telephone card) where information is protected by a SOC.

Reference will now be made in detail to examples of the invention, one or more embodiments of which are illustrated in the drawings. Each example is provided by way of explanation of the invention, and is not meant as a limitation of the invention. For example, features illustrated or described as part of one embodiment may be used with another embodiment to yield still a further embodiment. It is intended that the present invention encompass these and other modifications and variations as come within the scope and spirit of the invention.

Before describing the present invention, it may be useful to first provide a brief description of the current state of the art of instant ticket production and printing to ensure that a common lexicon is established of existing systems prior to disclosing the present invention. This description of the current state of the art of instant ticket production is provided in the discussions of FIG. 1 (non-screened overprints) and FIG. 2 (screened overprints) with printing methods provided in FIG. 3 (screened versus stochastic) and FIG. 4 (trapping).

FIG. 1 depicts a representative example of the variable indicia and associated security ink stack typical of a traditional ink jet SOC secured document—i.e., an instant lottery ticket 100. As shown in FIG. 1, the variable printed variable indicia 104 is inserted between lower security ink films 102 and 103 and upper security ink films 105 through 107 in an attempt to provide barriers protecting the variable indicia 104 from diffusion, candling, and other known attacks. The entire ink film stack is deposited on a paper, foil, or other substrate 101. The lower security-ink film layers provide opacity and diffusion barriers 102, as well as a higher contrast (e.g., white or gray) background 103, such that a human consumer can read the variable indicia 104. The upper security ink film layers also isolate the variable indicia 104, first with a clear release coating 105 that helps seal the variable indicia to the substrate and also causes any ink films printed on top of it to scratch-off. Next, one or more upper opacity layer(s) 106 is/are applied to help protect against candling and fluorescence attacks. On top of the opacity layer(s) one or more white ink film(s) 107 is/are typically applied that provides a higher contrast background for overprint inks. Finally, decorative overprint inks 108 and 109 are applied for both an attractive appearance of the SOC portion, as well as sometimes providing additional security. In addition to the security ink stacks, variable indicia, and overprint layers 102 through 109 of the ticket 100, there is also a decorative display printing portion 110 through 113 designed to make the ticket 100 more attractive and optionally provide instructions for game play. Typically, this display printing is printed via an offset or flexographic (i.e., fixed printing plate) process where the four primary printing colors Cyan 110, Magenta 111, Yellow 112, and blacK 113 (i.e., CMYK) are blended in varying intensity to mimic all colors perceived by a human.

Thus, a large number of security ink film layers (seven in the example of FIG. 1) are typically used to protect and allow for consumer readability of the variable indicia 104 of a traditional SOC protected document such as an instant lottery ticket. Of course, the example of FIG. 1 is just one possible arrangement of a traditional SOC protected document with security ink films, with the goal of any security ink film coating arrangement being to provide barriers to outside attempts to detect the variable indicia without legitimately removing the SOC.

Figure 2:
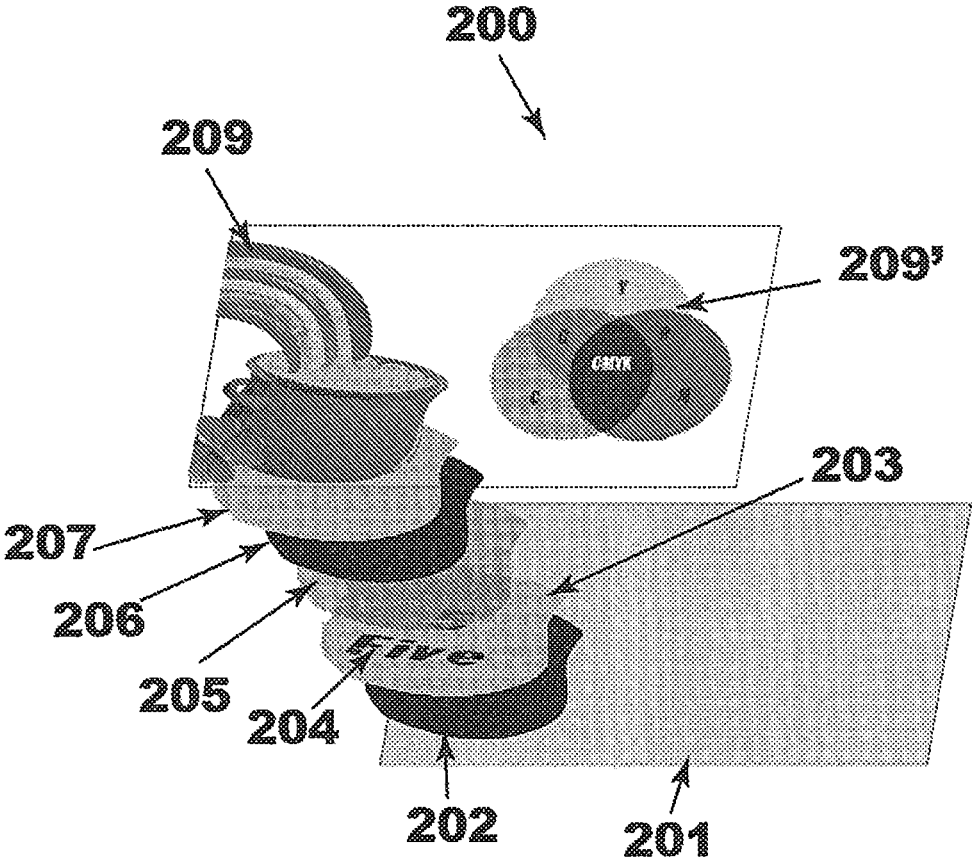
FIG. 2 (Prior Art)
FIG. 2 is an exploded isometric view of a second representative example of a traditional lottery-type instant ticket security ink film stack where the variable indicia is sandwiched in the stack with a common screened overprint applied to the SOC and display portions of the ticket.

For example, FIG. 2 provides an alternative exploded isometric view of an embodiment of a lottery-type instant ticket 200 with a security ink film stack protecting variable indicia where the display portion 209' and overprint portion 209 are both printed in the same screened process color (i.e., CMYK) application. In certain applications this alternative embodiment may be preferred where it is desirable to ensure that the graphics of the overprint portion 209 and the display portion 209' seamlessly blend together and may therefore provide a limited countermeasure to unassisted and assisted SOC lifting or floating techniques where the SOC is temporally "lifted" or "floated" by various means. The lifting or floating means for illicitly of the SOC allows for the underlying variable indicia 204 to be observed, and then the SOC can be rolled back into position and fixed with an adhesive, thereby making the ticket appear uncompromised. Additionally, screened process color overprints tend to be more attractive than spot colors.

The remainder of the prior art embodiment 200 of FIG. 2 is essentially the same as embodiment 100 (FIG. 1) with the variable printed variable indicia 204 located between lower security ink films 202 and 203 and upper security ink films 205 through 207 in an attempt to provide protective barriers against all known attacks on the SOC. As before, the entire ink film stack is deposited on a paper, foil, or other substrate 201. The lower security-ink film layers provide an opacity 202 barrier as well as a higher contrast (e.g., white or gray) background 203, such that a human consumer can read the variable indicia 204. The upper security ink film layers also isolate the variable indicia 204, first with a release coating 205 that helps seal the variable indicia to the substrate and also causes any ink films printed on top of it to scratch-off. Next, one or more upper opacity layer(s) 206 is/are applied. On top of the opacity layer(s) one or more white ink film(s) 207 is/are typically applied that provides a higher contrast background for overprint inks.

This alternative embodiment 200 would apparently provide a countermeasure to floating as well as unassisted and assisted SOC mechanical lift attacks by eliminating any clear demarcation between the overprint portion 209 and the display portion 209' with presumably any mechanical lift or float attempt disrupting the homogenous overprint 209 and display 209'. This disruption in image effect can be amplified by including fine lines (e.g. Benday printing) and/or other micro-printing around the boundary between the overprint portion 209 and the display portion 209'. However, as a practical matter, this countermeasure is somewhat limited, since it is difficult to obtain consistent printing results (both in terms of color and image sharpness) due to the differences in the printing surfaces to which the security portion (i.e., SOC) overprint portion 209 and the display portion 209' are applied. The SOC portion of the ticket on which the overprint 209 is printed, typically is a rougher surface and provides a different chemical and contrast ink film background than the smoother typically coated paper substrate 201 for the display printing portion 209'.

Additionally, the transition from the surfaces of the overprint portion 209 to the display portion 209' typically requires the screened overprint to maintain a consistent film while falling off of multiple ink film layers (e.g., five layers—202 through 207—as shown in FIG. 2). While this "ink film security tower" is a small height to human perception, it is very significant in terms of maintaining ink film consistency from the surfaces of the overprint portion 209 to the display portion 209'. When it is realized that a single screened ink film combined application of the overprint portion 209 and the display portion 209' is required to maintain continuity over a vertical distance of approximately five times its own thickness, it can be appreciated that printing both the overprint portion 209 and display portion 209' with a single screened application will be problematic at best—especially if fine lines and micro printing are included. Depending on the artwork design of the overprint portion 209 and the display portion 209', the resulting disruption in the printed line screen may even give a false positive indication of a SOC lift when none has been attempted. While there are some known techniques of mitigating this "ink film security tower" screened printing problem (e.g., gradually stepping out or making each subsequent security ink film layer have a little smaller area than the previous underlining layer, thereby changing the "ink film security tower" to an "ink film security ramp"), these techniques tend to also be problematic and require precision registration that is difficult to maintain over a long print run—especially for the clear release coat.

Figure 3:
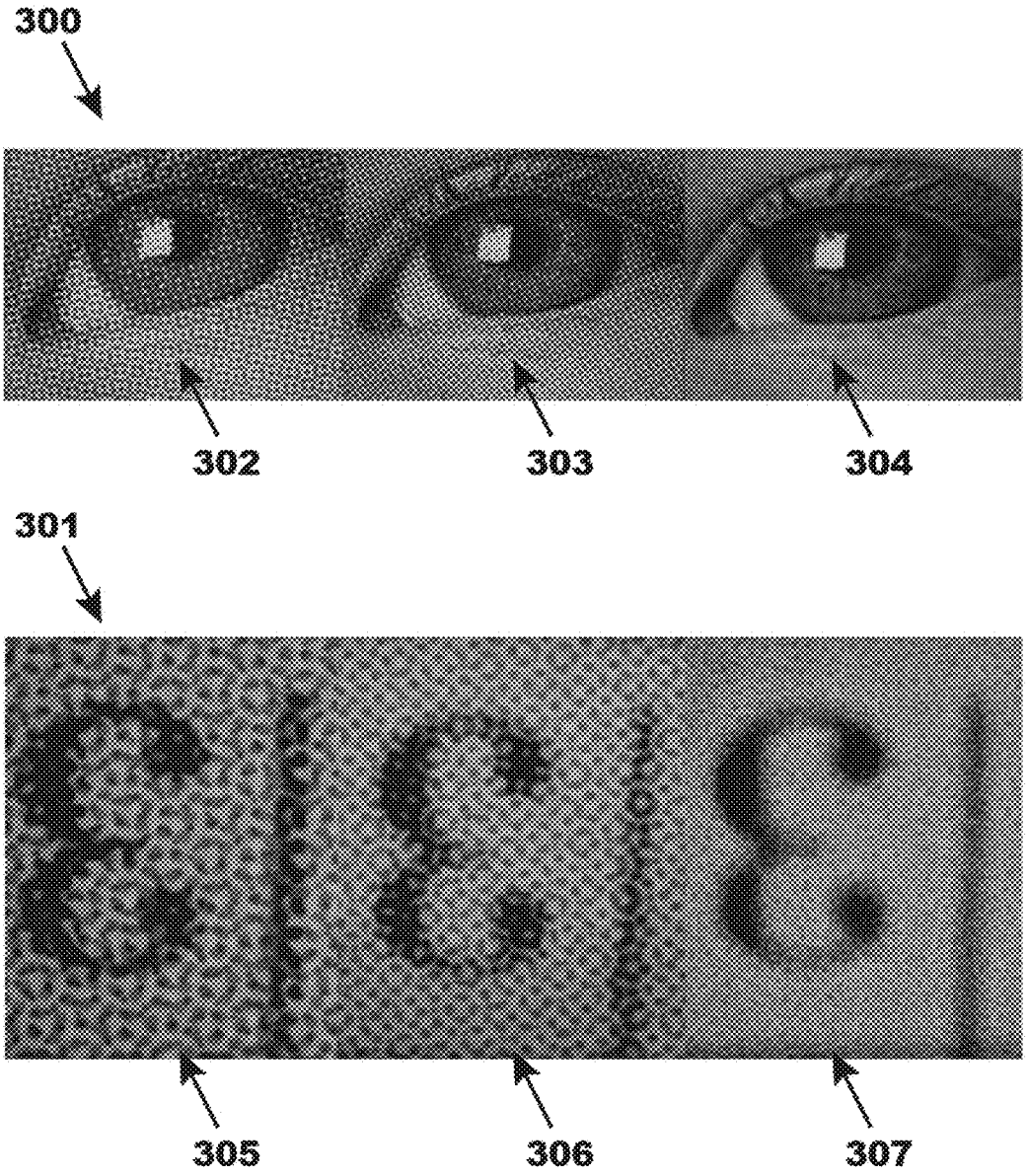
FIG. 3 (Prior Art)
FIG. 3 is a front plan view of representative examples of two different magnified images printed with 175 and 200 line screen as compared to the same images stochastic printed.

Fortunately, utilizing stochastic imaging for the security-enhanced SOC documents according to the present invention, instead of screened printing for overprints, can mitigate the problems of differences in surfaces between the SOC and paper substrate as well as the "ink film security tower." Since stochastic imaging does not rely on an AM fixed screen pattern to simulate halftones images, stochastic FM or hybrid FM-AM printed ink films tend to be less sensitive to surface irregularities and inconsistencies, since there is no virtual grid being deformed over non-planar substrates. For example, FIG. 3 illustrates magnified samples of two types of images (i.e., a photograph 300 and a decimal number 301) printed with a "175" AM line screen (images 302 and 305), a "200" AM line screen (images 303 and 306), compared to images applied by a FM stochastic imager (images 304 and 307). The virtual grid inherent in any form of AM line screen printing (images 302, 303, 305, and 306) can be readily observed in FIG. 3, in contrast to the smoother (i.e., more random) appearing arrangement of dots printed with the stochastic imager (images 304 and 307). Although stochastic image printing has been used on non-security-enhanced SOC documents as exemplified in FIG. 3, stochastic image printing has not been used on security-enhanced SOC documents. This pseudorandom appearing distribution of printed dots at a microscopic level with the FM stochastic method of printing typically produces a higher quality image that tends to be more immune to substrate surface irregularities including "ink film security tower" fall off. Compared to the prior art, with the present invention, the variable nature of stochastic imaging with FM and optionally hybrid FM-AM imaging overprint over the SOC portion and over the adjacent display portion readily enables images to be fine-tuned or trapped at known zones of demarcation (e.g., "ink film security tower" fall off), thereby further mitigating image distortion and possibly false indications of SOC lifts or floats.

Figure 4:
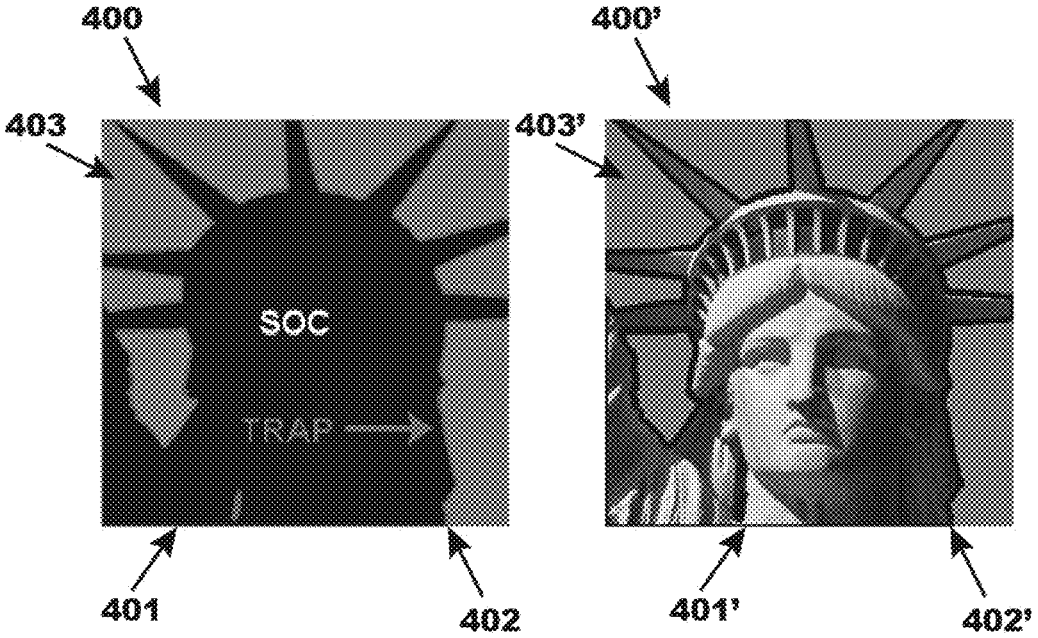
FIG. 4 (Prior Art)
FIG. 4 is a front plan view of a representative magnified example of traditional trapping overlapping the SOC and display border demarcation.

The term of "trapping," well known in the art, is defined as allocating a finite amount of space, such as one printer dot (e.g., "1/72-inch" or 0.35 mm in diameter or other major dimension for non-circular shapes), where one color and or layer transitions into another. Traditionally, trapping is implemented to allow for a small amount of out-of-register condition for printing presses so as not to produce any white voids due to the substrate showing through any out-of-register gaps. The simplest trap uses a solid object such as a line to hide the gaps. FIG. 4 illustrates one prior art example of imaging 400 highlighting the SOC area and the trap, shown in the form of a solid line, and 400' showing the SOC with a screened overprint. In FIG. 4 trap 402, shown in red in the color FIG. 4, and trap 402', shown in a black outline around the image in the color FIG. 4, is employed between the SOC portion and the display portion. See the red trap 402 between the SOC 401, shown in black silhouette in color FIG. 4 and the display portion 403, shown in blue in color FIG. 4. See the black trap 402' between the SOC overprint portion 401', shown in green in color FIG. 4, and the display portion 403', shown in blue in color FIG. 4. This type of trapping would most likely be employed when the overprint portion and the display portion of an instant ticket would be printed as separate processes (see FIG. 1). With this type of trapping, any SOC and display demarcation (e.g., "ink film security tower" fall off) would be minimized at the expense of probable loss of sensitivity to SOC lifts or float attacks. Furthermore, as shown in FIG. 4, this traditional implementation also has the disadvantage that any photographic image has an outline, which is typically not aesthetic.

Figure 5:
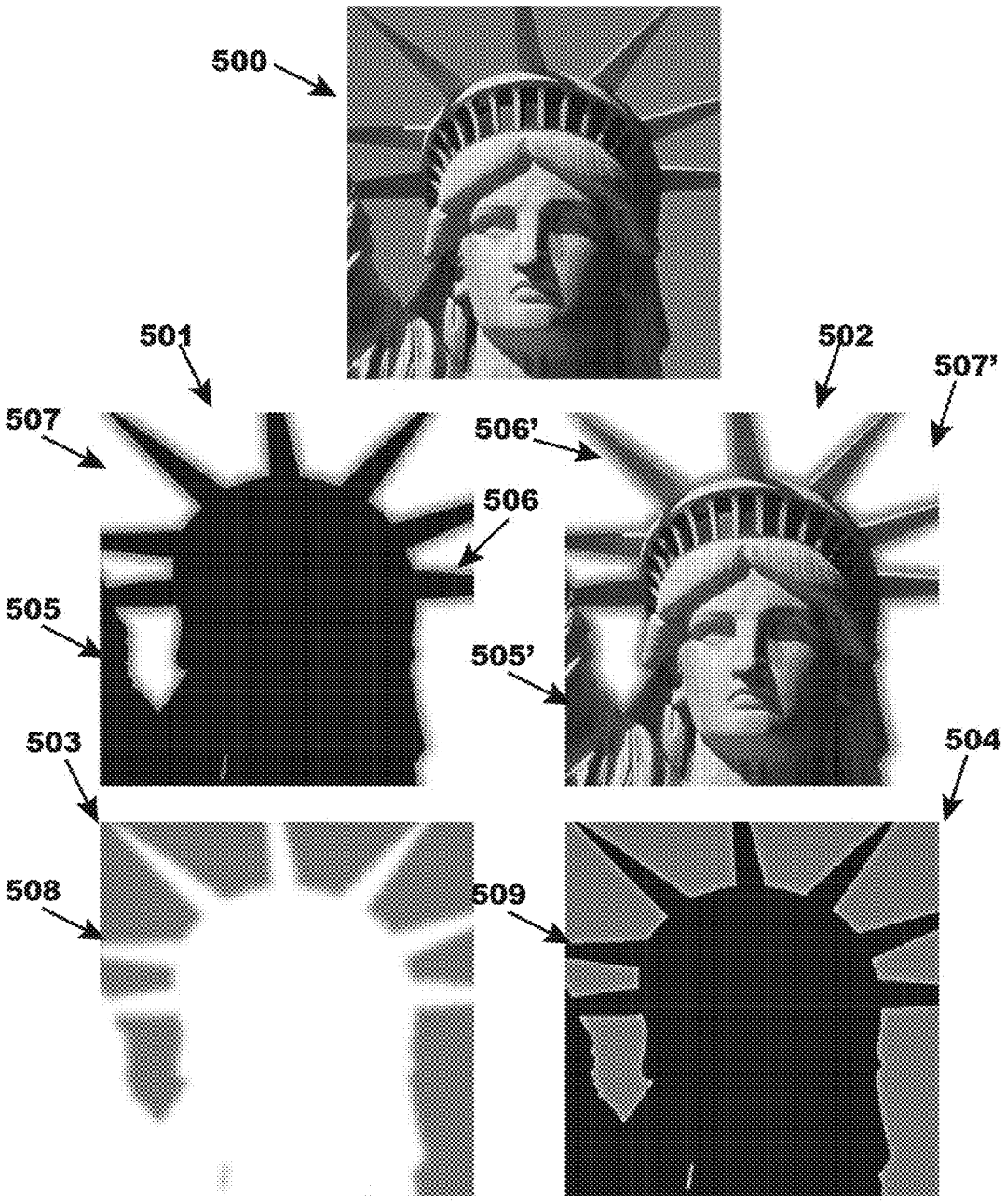
FIG. 5 is a front plan view of embodiments of a representative magnified example of stochastic fade trapping overlapping the SOC and display border demarcation areas.

Compared to traps in the form of a solid line shown in the prior art of FIG. 4 the present invention uses a continuous blend of stochastic image printing from the SOC portion to the display portion—see image 500 of FIG. 5. In one embodiment, the images of FIG. 5 are produced via two separate processes—i.e., a first process where the overprint portion over the SOC portion is printed via a stochastic imager with the display portion printed via traditional line screen printing, and a second process where the overprint portion over the SOC portion and the display portion are printed by two separate stochastic imagers. In this second process, blending techniques are used to mitigate the figure's transition from the SOC overprint portion to the display portion, even though two different images are applied with at least the overprint portion overlying the SOC produced via a stochastic imager. When utilizing separate printing processes for the overprint portion and the display portion, a continuous fade between the two portions can be created, minimizing demarcation transitions while maintaining security against SOC lifts and floats. With this technique, the top (overprint portion overlaying the SOC) stochastic imager extends the blend outside the area of the SOC portion into the display portion by stochastically fading the overlapping portion gradually from the overprint portion overlying the SOC onto the display portion. Thus, in this embodiment, the blend extending beyond the SOC will cover any mis-registration of the imagers, as well as minimize demarcation areas between the SOC overprint portion and the display portion.

For example, refer to images 501 and 502 of an instant ticket that includes security coatings that will ultimately be scratched-off by the consumer in color FIG. 5. The images 501 and 502 respectively show a SOC portion 505, shown in black silhouette, and the SOC stochastic overprint portion 505', shown in green. For the instructive purposes of this example, the display portion 507 and 507' of the instant ticket is simply illustrated as a white background 507 and 507', but it is to be understood that more complex display backgrounds are possible and desirable in many cases. As shown in FIG. 5, the stochastic blend area 506 and 506', also called a "fade trap" portion or area, shown in a fading blue area transitioning from the black SOC portion 505 and the green overprint 505' overlaying the SOC to the blue display portion 507 and 507', gradually fades in intensity and saturation as the distance increases from the SOC or SOC overprint portions 505 and 505'. This stochastic fade trap portion literally blurs the demarcation boundary area variances (e.g., "ink film security tower") between the black SOC 505 and the white display portion 507, and between the green SOC overprint portion 505' and the display portion 507', thereby effectively camouflaging printing irregularities at the boundary, while at the same time providing a SOC lift and float countermeasure by subtly extending the stochastic SOC overprint ink film onto the display portion. The microscopic pseudorandom FM arrangement of stochastic printed dots makes realignment attempts very difficult after a SOC lift or float. The stochastic fading also functions as a trap protecting against mis-registration between ink film layers.

In one embodiment, both the SOC overprint portion and the display portion would be printed with separate stochastic imagers. In this embodiment, the stochastic fading effect is enhanced with both the SOC overprint and the display imagers contributing stochastic fade. In this embodiment, the stochastic display image portion (at a lower level) would contain a complimentary blend to the stochastic SOC overprint (at an upper level), thereby enhancing the illusion of a continuous ink film between the stochastic SOC overprint portion and the stochastic display portion. For example, color FIG. 5 illustrates the fading blue stochastic trap portion 508 with increased saturation into the blue display portions 503 and 504.

Figure 6:
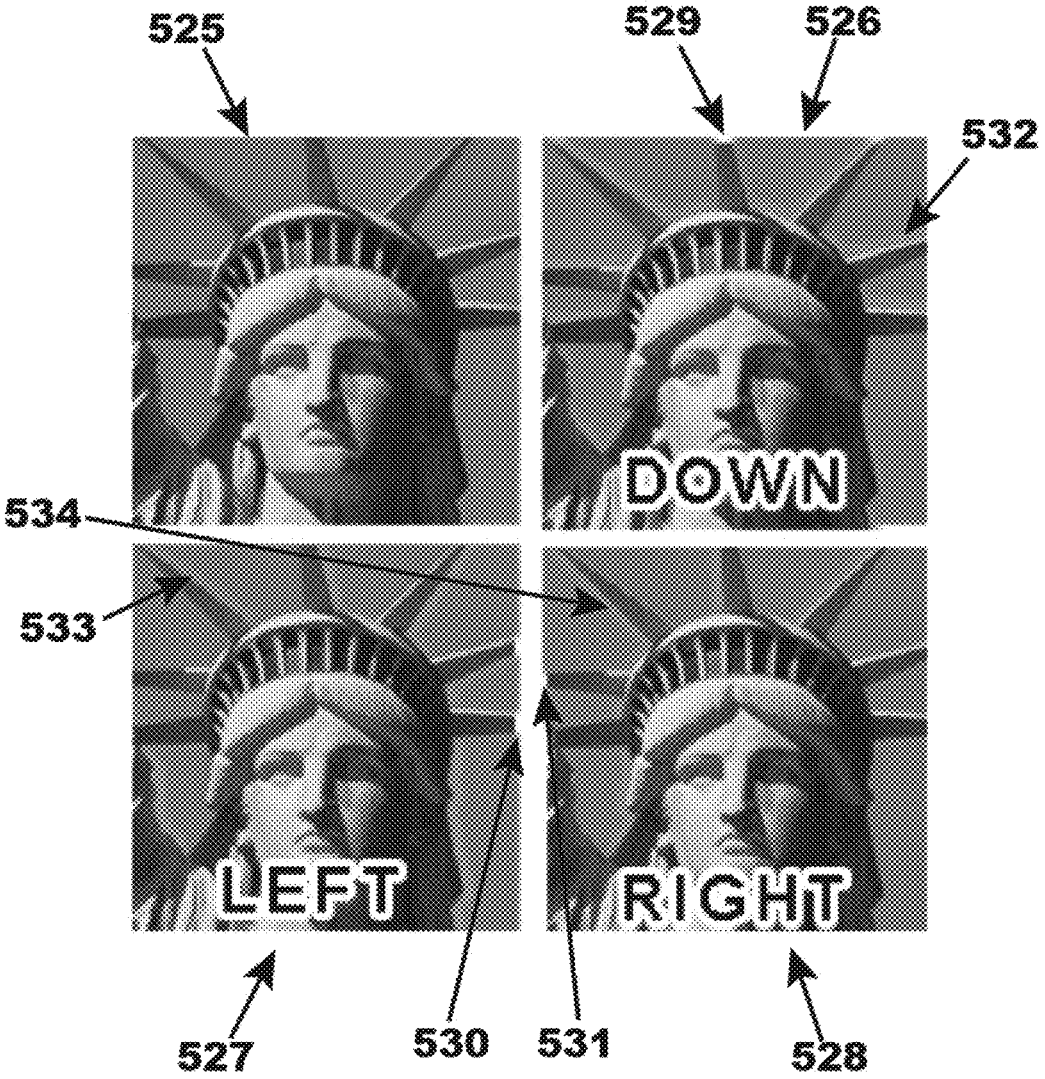
FIG. 6 is a front plan view of a representative magnified example of stochastic fade trapping obscuring miss-registration of the embodiments of FIG. 5.

In another embodiment, the width of the stochastic fade trap area can be increased, thus reducing press registration requirements. With stochastic fade, the trapping areas can be much larger than aesthetically possible for solid lines, since the stochastic fade portions(s) tend to blend into the overall image, such that any mis-registration and blending occurs on a micro level and consequently, is not noticed by most observers. Thus, larger stochastic trap fade portions are possible over traditional line traps—e.g., over the area of two (1/32 inch or 0.8 mm), three (1/16-inch or 1.6 mm), or four (1/8-inch or 3.8 mm printer dots, as opposed to typically over the area of one printer dot (1/72-inch or 0.35 mm) for more traditional line traps. For example, color FIG. 6 illustrates four copies 525 through 528 of the same image. The copy 525 is completely in register. The copy 526 is grossly out of register, (i.e., approximately 1/8-inch or 3.8 mm out-of-register), being too low in the vertical axis. The copy 527 is grossly out of register too far left in the horizontal axis. The copy 528 is grossly out of register too far right in the horizontal axis. Notice that the primary indication of an out-of-register condition exists is where the stochastic SOC overprint portion drifts away from the edge (at locations 529, 530, and 531), but not where the stochastic SOC overprint portion and the stochastic display portion share a stochastic fade (at locations 532, 533, and 534).

The technique of stochastic fading also can be applied by a single application of both overprint and display by a single stochastic imager. In this alternative embodiment, the stochastic fade trap portions 506 and 506' are printed by a single imager with previously known areas of printing irregularities (e.g., demarcation boundary "ink film security tower" fall off), including relatively wide areas of stochastic fading. Thus, even though the single stochastic print application may experience the same physical disruptions as AM screen printed images, the appearance of disturbed images can be minimized. Additionally, with prior art AM screen printing, common printing of both the SOC overprint portion and the display portion may result in differences in color and laydown due to the difference in substrate surfaces between the display portion (e.g., smooth, coated primer paper) and the SOC portion (e.g., relatively rough surface with low graphic adhesion). An advantage of this alternative embodiment of printing both the SOC overprint portion and the display portion with a common stochastic imager is that the visual impact of any potential differences in the SOC overprint portion and the display portion in terms of color and laydown can be minimized by creating a fuzzy boundary between the two portions with the use of stochastic fading. This stochastic fading portion effectively blends the two different SOC overprint portion and the display portion together.

While stochastic imaging tends to be more tolerant to surface irregularities and therefore, offers greater printability of SOC type documents, while also offering immunity to false indications of SOC lifts or floats, stochastic imaging is also unexpectedly better at highlighting mechanical SOC lifts under some circumstances. By the virtual grid nature of AM screened images, fine cut lines made parallel to either screen axis of the virtual grid tend to be less obvious to the unaided human eye than non-parallel cut lines. This is because parallel cut lines tend to blend in with the overall pattern inherent in a virtual grid and deform a minimal number of periodically printed AM dots. Conversely, since stochastic imaging does not feature a periodic printed dot distribution, but primarily varies dot position (i.e., FM), it does not include anything resembling a virtual grid—e.g., see FIG. 3 stochastic images 304 and 307 as compared to AM screen images 302, 303, 305, and 306. Consequently, since stochastic imaging theoretically offers no underlying patterns or symmetries for an attacker to exploit, there are no hypothetical cut angles inherent in stochastic imaging that will make a mechanical lift attempt less obvious.

Figure 7:
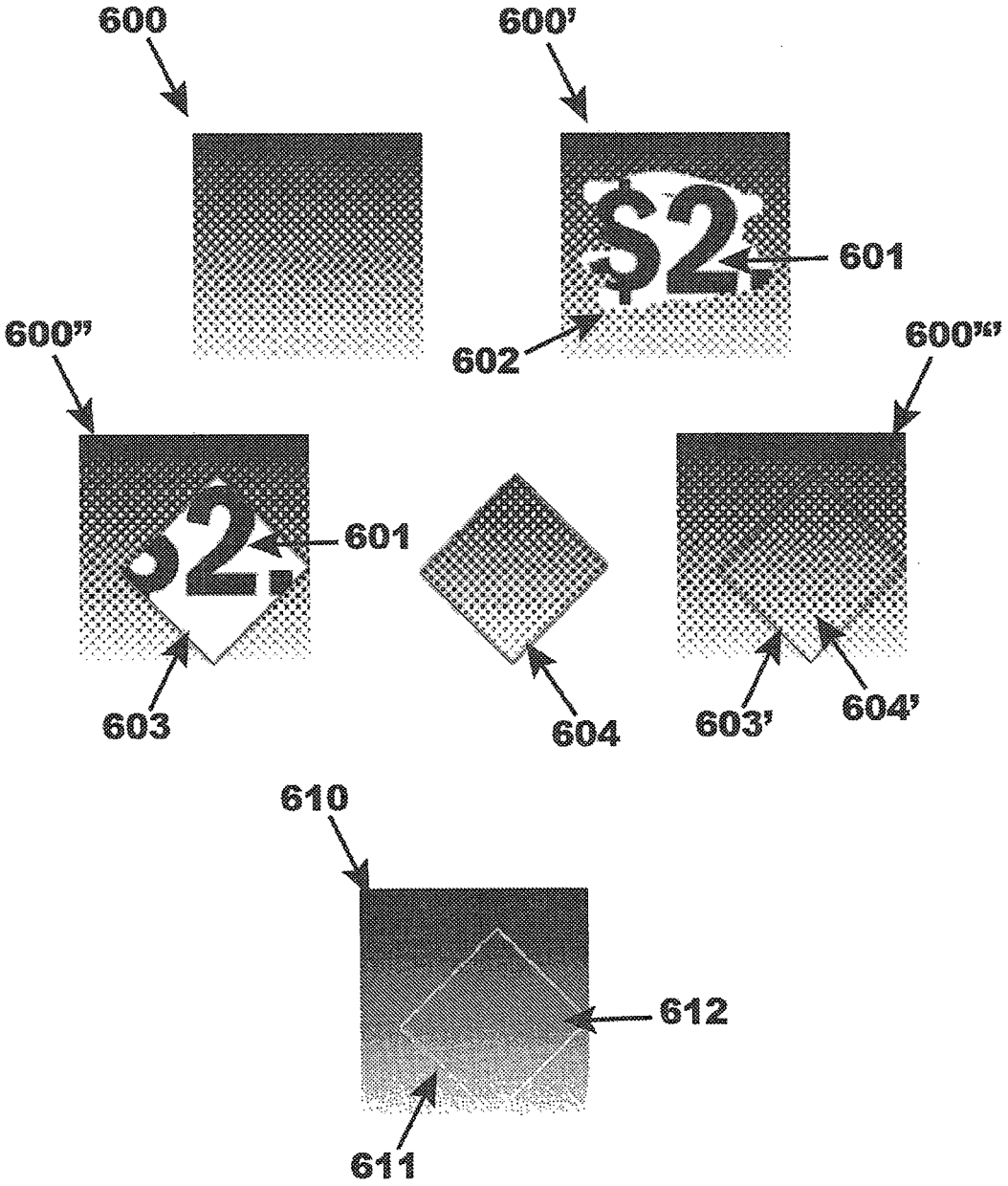
FIG. 7 is a front plan view comparison of illustrative SOC lifts executed with line screen and stochastic overprints.

For example, FIG. 7 depicts a graduated line screen SOC overprint portion (600, 600', and 600") with variable indicia 601 depicting two dollars "$2." The overprint as illustrated is a magnified 0.2 inch×0.2 inch (5.1 mm×5.1 mm) of printing area, with a 45°, 150 LPI (Lines Per Inch) screen, at 1600 dpi (Dots Per Inch). The line screen sample 600' is illustrated partially scratched-off at image 601 with irregular edges 602 typical of standard consumer SOC removal. In contrast, the line screen sample 600" illustrates the same variable indicia 601 partially revealed after a mechanical SOC lift using a flat blade (e.g., X-Acto® chisel blade #17) or other device to lift or cut out a portion of the SOC. Notice the straight border edges 603 indicative of a SOC lift. The diamond shaped square lifted portion of the SOC 604 is shown fully removed in FIG. 7 for instructive purposes. With normal SOC lifts, one edge (e.g., upper right) is typically left intact to simplify realignment and reattachment of the lifted SOC portion 604 after illicit identification of the indicia 601. After realignment and reattachment in image 600'" of the lifted SOC portion 604', the remaining cut outline 603' can be effectively camouflaged to casual human inspection so long as the cut outline 603' is parallel with the axis or axes of the line screen overprint. Thus, with traditional line screens, the actual amount of human detectable visual damage resulting from a mechanical SOC lift can be minimized to the point that most players would not notice.

Conversely, with the use of stochastic, instead of traditional, line screen SOC overprints, the possibility of performing SOC lifts cuts along the axis of a periodic arrangement of imaged dots (i.e., AM) is no longer available. As illustrated in FIG. 7, in the stochastic SOC overprint sample 610, the virtually randomized dot placement (i.e., FM) eliminates any clear straight line cut path that does not damage multiple imager dots. Thus, an SOC lift 612 leaves a more obvious cut outline 611, making both assisted and unassisted SOC lifts mostly detectable with even casual consumer inspection. Consequently, mechanical SOC lifts are no longer a viable method of illicitly determining the hidden variable indicia's identity when stochastic image overprinting is used.

Of course, there are other variations of the disclosed embodiments that would be apparent to anyone skilled in the art in view of this disclosure.

What is claimed is:

1. A security-enhanced document that when printed has (i) a scratch-off coating that covers variable indicia, (ii) a display portion that provides non-secure decorative printing and is visible on the document before and after removal of the scratch-off coating, (iii) a stochastic overprint of the scratch-off coating, and (iv) a demarcation boundary between the display portion and the stochastic overprint of the scratch-off coating, the security-enhanced document comprising:

a substrate;

a display portion printed directly or indirectly on the substrate formed by an application of a first stochastic imager;

a lower level fade trap portion about the demarcation boundary printed directly or indirectly on the substrate formed by the application of the first stochastic imager;

at least one release coat applied over the variable indicia;

the scratch-off coating applied over the release coat to maintain the variable indicia unreadable until removal of the scratch-off coating;

the stochastic overprint of the scratch-off coating formed by an application of a second stochastic imager; and an upper level fade trap portion about the demarcation boundary formed by the application of the second stochastic imager.

2. The document as in claim 1, wherein the stochastic image overprint is comprised of process colors.

3. The document as in claim 1, wherein the stochastic image overprint is comprised of FM imaging.

4. The document as in claim 1, wherein the stochastic image overprint is comprised of hybrid FM-AM imaging.

5. The document as in claim 1, wherein the display portion further provides instructions for use of the document.

6. A method for making a security-enhanced document that when printed has (i) a scratch-off coating that covers variable indicia, (ii) a display portion that provides non-secure decorative printing and is visible on the document before and after removal of the scratch-off coating, (iii) a stochastic overprint of the scratch-off coating, and (iv) a demarcation boundary between the display portion and the stochastic overprint of the scratch-off coating, the method comprising:

(a) printing directly or indirectly on the substrate by an application of a first stochastic imager:

(i) the display portion, and (ii) a lower level fade trap portion about the demarcation boundary;

(b) printing at least one release coat over the variable indicia;

(c) printing the scratch-off coating over the release coat to maintain the variable indicia unreadable until removal of the scratch-off coating; and (d) printing by an application of a second stochastic imager:

(i) the stochastic overprint of the scratch-off coating, and (ii) an upper level fade trap portion about the demarcation boundary.

7. The method of claim 6, wherein step (d) comprises printing the stochastic image overprint using process colors.

8. The method of claim 6, wherein step (d) comprises printing the stochastic image overprint using FM imaging.

9. The method of claim 6, wherein step (d) comprises printing the stochastic image overprint using hybrid FM-AM imaging.

10. The method of claim 6, wherein the display portion further provides instructions for use of the document.

* * * * *